US009915258B2

(12) United States Patent
Perez et al.

(10) Patent No.: US 9,915,258 B2
(45) Date of Patent: Mar. 13, 2018

(54) SYSTEM FOR HEATING A COMPRESSOR ASSEMBLY IN AN HVAC SYSTEM

(71) Applicant: Lennox Industries Inc., Richardson, TX (US)

(72) Inventors: Eric Perez, Hickory Creek, TX (US); Rakesh Goel, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 15/279,612

(22) Filed: Sep. 29, 2016

(65) Prior Publication Data

US 2017/0016439 A1 Jan. 19, 2017

Related U.S. Application Data

(63) Continuation of application No. 14/048,221, filed on Oct. 8, 2013, now Pat. No. 9,482,222.

(51) Int. Cl.

| | |
|---|---|
| ***H05B 3/02*** | (2006.01) |
| ***F04B 49/02*** | (2006.01) |
| ***F04B 49/06*** | (2006.01) |
| ***F25B 31/00*** | (2006.01) |
| ***F25B 43/02*** | (2006.01) |
| ***F25B 49/02*** | (2006.01) |

(52) U.S. Cl.

CPC ..... *F04B 49/02* (2013.01); *F04B 49/06* (2013.01); *F25B 31/002* (2013.01); *F25B 43/02* (2013.01); *F25B 49/022* (2013.01); *F25B 2400/01* (2013.01); *F25B 2500/16* (2013.01); *Y10T 137/0318* (2015.04); *Y10T 137/6416* (2015.04)

(58) Field of Classification Search

CPC ..... F25B 31/002; F25B 43/02; F25B 49/022; F25B 2400/01; F25B 2500/16; F04B 49/02; F04B 49/06; H05B 3/02

See application file for complete search history.

(56) References Cited

U.S. PATENT DOCUMENTS

| | | | |
|---|---|---|---|
| 5,572,878 | A | 11/1996 | Kapoor |
| 2010/0011788 | A1 | 1/2010 | Lifson et al. |
| 2011/0070100 | A1 | 3/2011 | McSweeney et al. |
| 2012/0148283 | A1 | 6/2012 | Sano et al. |

FOREIGN PATENT DOCUMENTS

| | | | |
|---|---|---|---|
| EP | 0090760 | A2 | 10/1983 |
| EP | 0546982 | A1 | 6/1993 |

OTHER PUBLICATIONS

Hotwatt; "Ohms Law and Wiring Diagrams"; Aug. 23, 2011; https://web.archive.org/web/20110823082157/http:/www.hotwatt.com/Ohm%20Law/wiring.htm; accessed on Apr. 28, 2016.

Yahoo Answers; "Two Heating Elements"; 2013; https://answers.yahoo.com/question/index?qid=20130412031109AA8RZLy; accessed on Apr. 28, 2016.

*Primary Examiner* — Brian Jennison

(74) *Attorney, Agent, or Firm* — Winstead PC

(57) ABSTRACT

The present invention provides a system for heating a compressor assembly of a heating, ventilation, and air conditioning (HVAC) system. The system comprises a heat source for transferring thermal energy to a plurality of compressor units. A controller varies the thermal energy transferred to the compressor units, between at least two substantially non-zero rates of transfer of thermal energy, in a plurality of modes of operation of the HVAC system.

20 Claims, 11 Drawing Sheets

SYSTEM FOR HEATING A COMPRESSOR ASSEMBLY IN AN HVAC SYSTEM

CROSS-REFERENCED APPLICATIONS

This application is a continuation of U.S. patent application Ser. No. 14,048,221, filed on Oct. 8, 2013. U.S. patent application Ser. No. 14,048,221 is incorporated herein by reference.

BACKGROUND OF THE INVENTION

Field of the Invention

The present invention relates to compressors used in heating, ventilation, and air conditioning (HVAC) systems and, more particularly, to a system for heating compressors in an HVAC system.

Description of the Related Art

A compressor of a heating, ventilation, and air conditioning (HVAC) system requires a lubricant to protect internal surfaces operating under high loads from contacting each other. The lubricant in the compressor is a mixture of oil and refrigerant that is used in a cooling or heating cycle of the HVAC system. Oil typically remains within the compressor, where it is most useful, but small amounts are carried over into refrigerant lines, the condenser, and the evaporator of the HVAC system.

At the end of the cooling cycle, some refrigerant may migrate to the compressor, where it is absorbed by oil in the compressor sump. When the compressor is started ("start-up"), an abnormal start-up condition, commonly referred to as vapor compression lock-up or ("VCL"), may occur. One contributing factor to a VCL event is dilution of oil in the compressor sump due to refrigerant migration.

In a VCL event, the pressure in the crankcase drops suddenly at start-up, causing the refrigerant in the compressor sump to flash to a vapor. The crankcase pressure will then rise, rapidly releasing refrigerant and lubricant into the discharge line of the compressor. As this occurs, the compressor is also pushing refrigerant through the condenser coil to generate high pressure liquid refrigerant, needed to open the thermal expansion valve ("TXV") to the evaporator. Due to the relatively low internal volume of the condenser coil, the sudden surge of refrigerant and oil from the crankcase causes a back-up of refrigerant at the discharge line, increasing pressure.

When the refrigerant absorbed in oil flashes to a vapor at start-up, a foam comprising oil diluted by refrigerant vapor rises into the moving parts of the compressor. As a result, the lubricating ability of the oil is reduced and metal-to-metal contact of compressor parts can occur, until the refrigerant is sufficiently removed from the oil. Furthermore, oil pushed into the discharge line and into the rest of the system may deprive the compressor sump of a reservoir of oil sufficient to lubricate the compressor, which further contributes to the problems caused by VCL.

The sudden increase in pressure from refrigerant at the discharge line may trip a high pressure sensor, causing the HVAC unit to become inoperable, until the sensor is reset. Condensers configured with micro-channel condenser coils are more vulnerable to VCL, because the lower internal volume slows the rate at which refrigerant may flow through the coil, increasing the pressure at the compressor discharge line.

To lessen the likelihood of a VCL event in conventional HVAC systems, heaters are mounted to the crankcase of the compressor to increase the temperature of the compressor sump, during times when the HVAC unit is not operating. Increasing the temperature of the compressor sump forces refrigerant away from the compressor and increases the amount of refrigerant in the condenser. At start-up, the compressor operates as intended, pumping high pressure vapor refrigerant to the condenser and facilitating heat exchange.

The crankcase heaters have a relatively low wattage rating, e.g. 100 W for a compressor of 5 ton capacity. The low wattage necessitates that the crankcase heaters be on continuously when the compressor is off in order to keep refrigerant away from the compressor.

VCL may also occur the first time the HVAC unit is started after installation. Standard operating procedure is to turn on the crankcase heaters about 24 hours prior to the start-up time of the compressors.

What is needed are HVAC systems and methods that will improve the reliability and efficiency of HVAC units, reducing down time for maintenance and repair, and extending the life of the unit.

SUMMARY

The present invention provides a system for heating a compressor assembly operating in a heating, ventilation, and air conditioning (HVAC) system. A controller varies the thermal energy transferred to the compressor units, between at least two substantially non-zero rates of transfer of thermal energy, in a plurality of modes of operation of the HVAC system.

BRIEF DESCRIPTION OF THE DRAWINGS

For a more complete understanding of the present invention and the advantages thereof, reference is now made to the following Detailed Description taken in conjunction with the accompanying drawings, in which.

DETAILED DESCRIPTION

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. Additionally, for the most part, details concerning well-known elements have been omitted inasmuch as such details are not considered necessary to obtain a complete understanding of the present invention, and are considered to be within the understanding of persons of ordinary skill in the relevant art.

Figure 1:
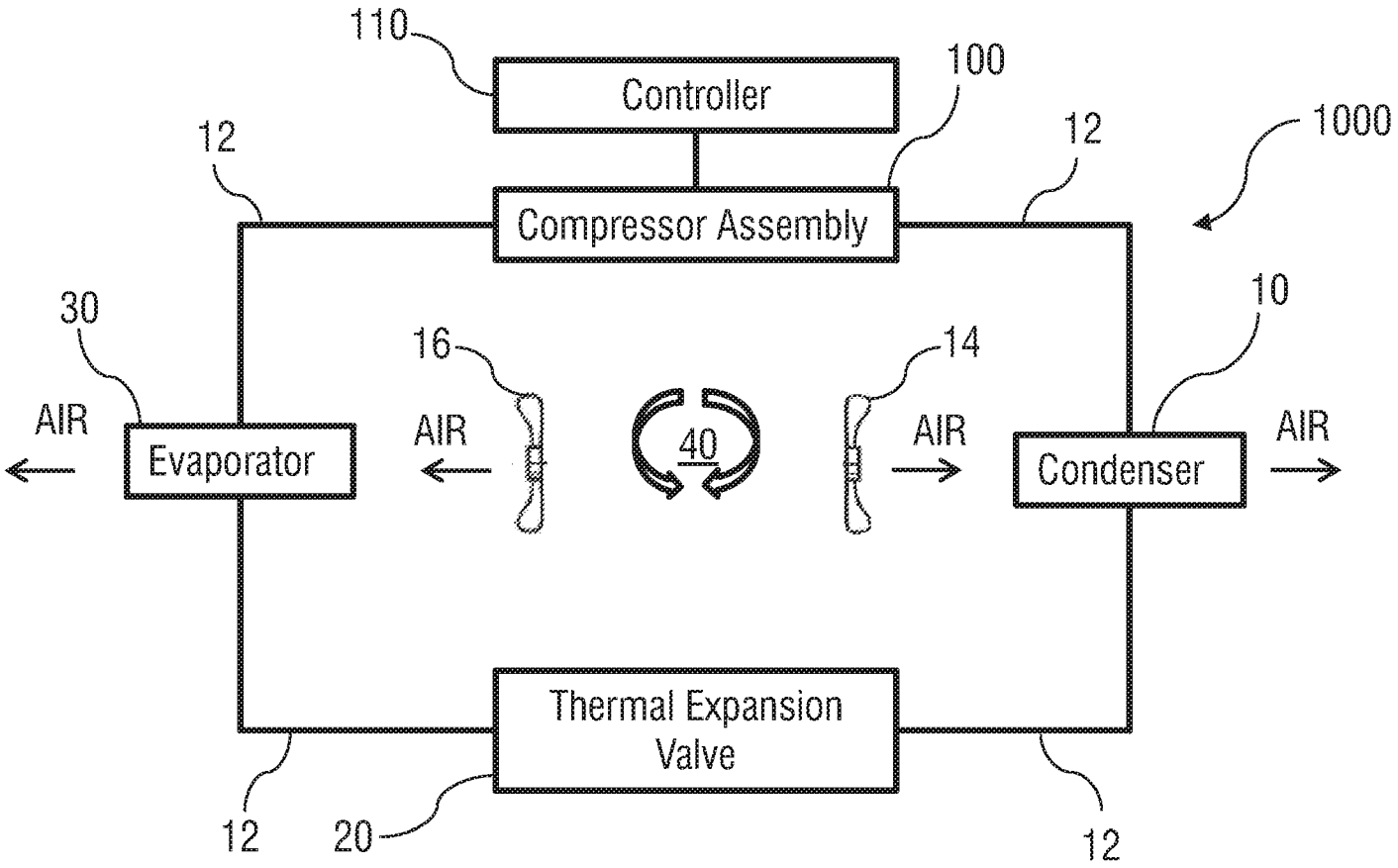
FIG. 1 illustrates an HVAC system.

Referring now to FIG. 1, an HVAC system 1000 comprises a compressor assembly 100 operationally connected by flow lines 12 to a condenser 10 with a first blower 14, a thermal expansion valve 20, and an evaporator 30 with a second blower 16. The HVAC system 1000 may be configured for heating or cooling in an operation cycle 40 for maintaining a desired temperature profile in an enclosed space, such as a home or business. A controller 110 may be operationally connected with the compressor assembly 100

Figure 2:
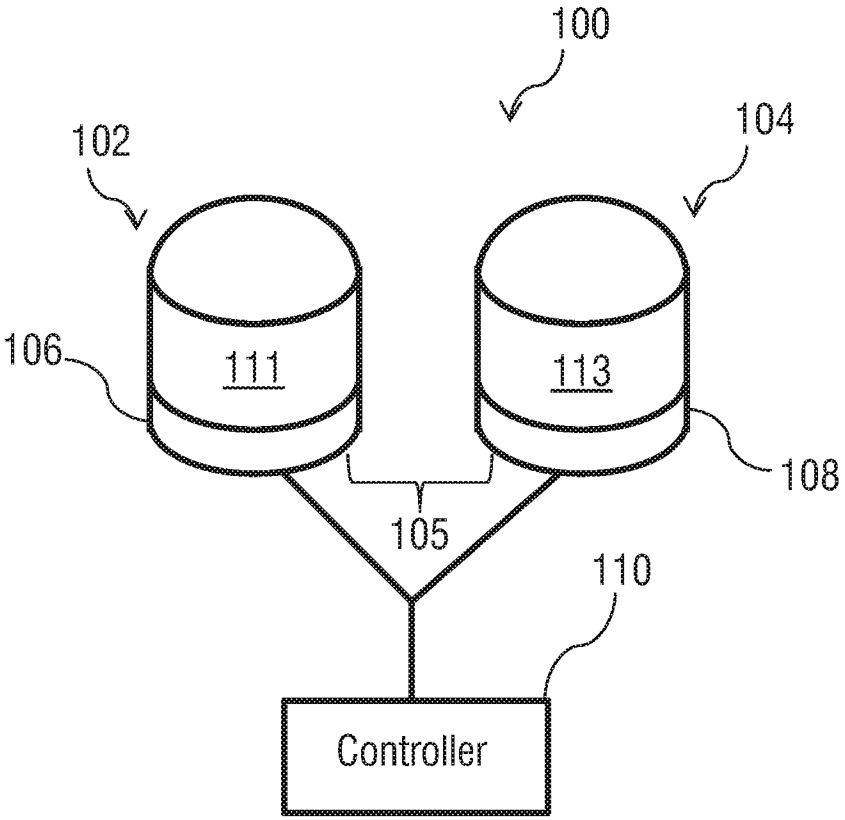
FIG. 2 illustrates a compressor assembly of an HVAC system.

Referring to FIG. 2, the compressor assembly 100 may comprise one or more compressor units operating in tandem. As shown in FIG. 2, a first compressor unit 102 and a second compressor unit 104 configured to convert relatively cool refrigerant in a vapor state to a high pressure, heated vapor that may be utilized in the heat exchange process of the operation cycle 40 (shown in FIG. 1). Each compressor unit 102, 104 is configured with a first crankcase 111 and a second crankcase 113, respectively. It will be understood that each compressor unit 102, 104 will comprise other typical components not shown here, including the compressor motor, oil pump, scrolls, bearings, and other well-known components.

Each of the first compressor unit 102 and the second compressor unit 104 may be operationally connected to a heat source 105 for transferring heat to each of the first compressor unit 102 and the second compressor unit 104. In the embodiment shown in FIG. 2, the heat source 105 comprises a first heater 106 operationally connected to the first compressor unit 102, and a second heater 108 operationally connected to the second compressor unit 104.

The first heater 106 and the second heater 108 may each comprise a resistance element-type heater. As shown in FIG. 2, each heater 106, 108 may be mounted on an external side of each crankcase 111, 113. It will be understood by persons of ordinary skill that the manner of attachment of each heater 106, 108 to each crankcase 111, 113 may vary. For example, a heating element (not shown) of each heater 106, 108 may be inserted into each crankcase 111, 113.

At least one of the first heater 106 and the second heater 108 may be configured to receive a variable voltage regulated by the controller 110. The controller 110 may vary the wattage output of one of the first heater 106 and second heater 108 or both. It will be understood by persons of ordinary skill in the art that the heat source 105 may comprise other types of sources of thermal energy.

Figure 3:
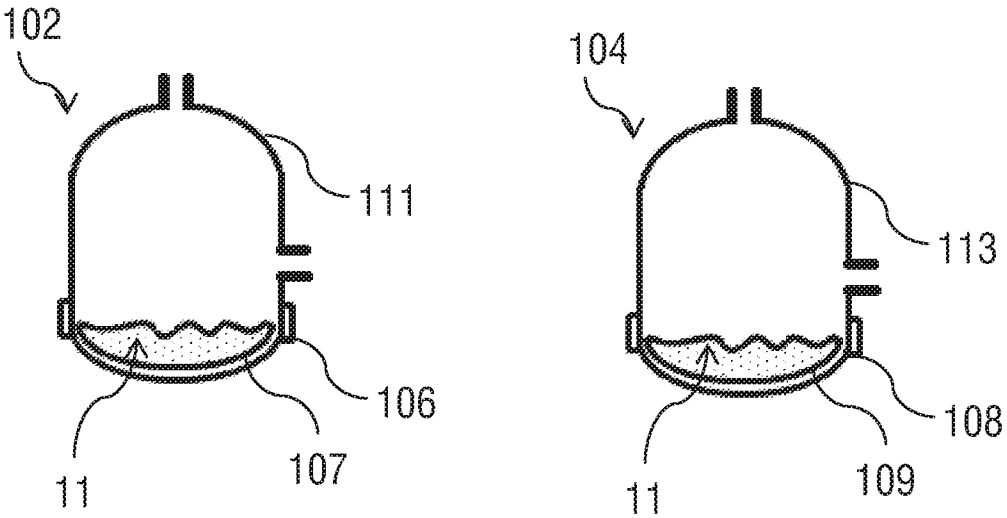
FIG. 3 is an illustration showing compressor sumps of a first compressor unit and a second compressor unit operating in tandem in an HVAC system.

Referring to FIG. 3, the first heater 106 and the second heater 108 may further comprise a first compressor sump 107 and a second compressor sump 109, respectively. Each compressor sump 107, 109 is configured as a collection vessel for lubricant 11, e.g. oil, used in the HVAC system 1000. During periods when the compressor units 102, 104 are not operating, oil and other lubricants, including refrigerant may collect in the compressor sumps 107, 109.

Figure 4A:
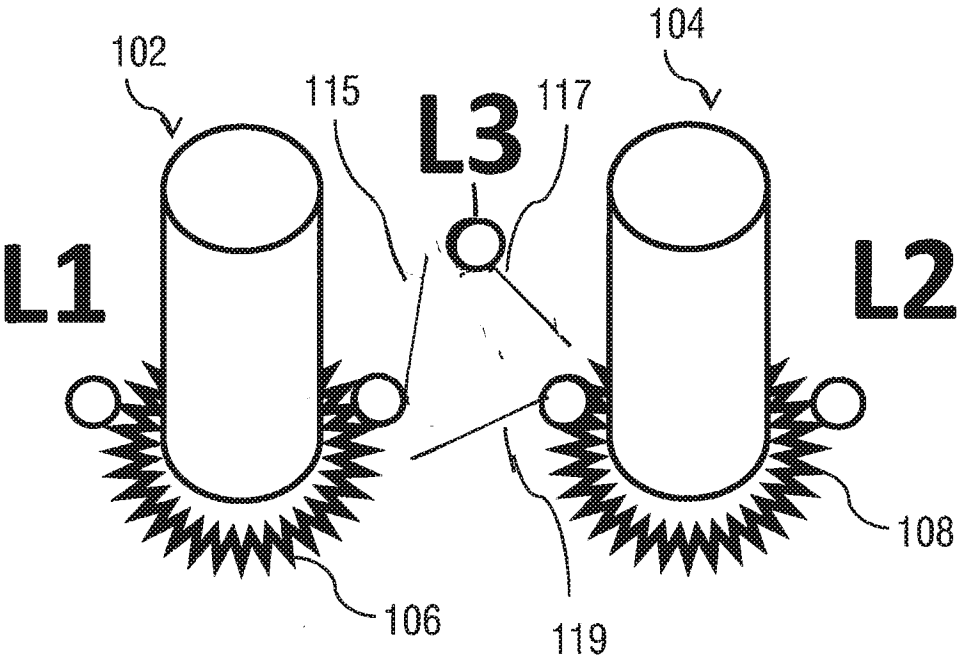
FIG. 4A is an electrical diagram of heaters of a compressor assembly operating in a first mode.
Figure 4B:
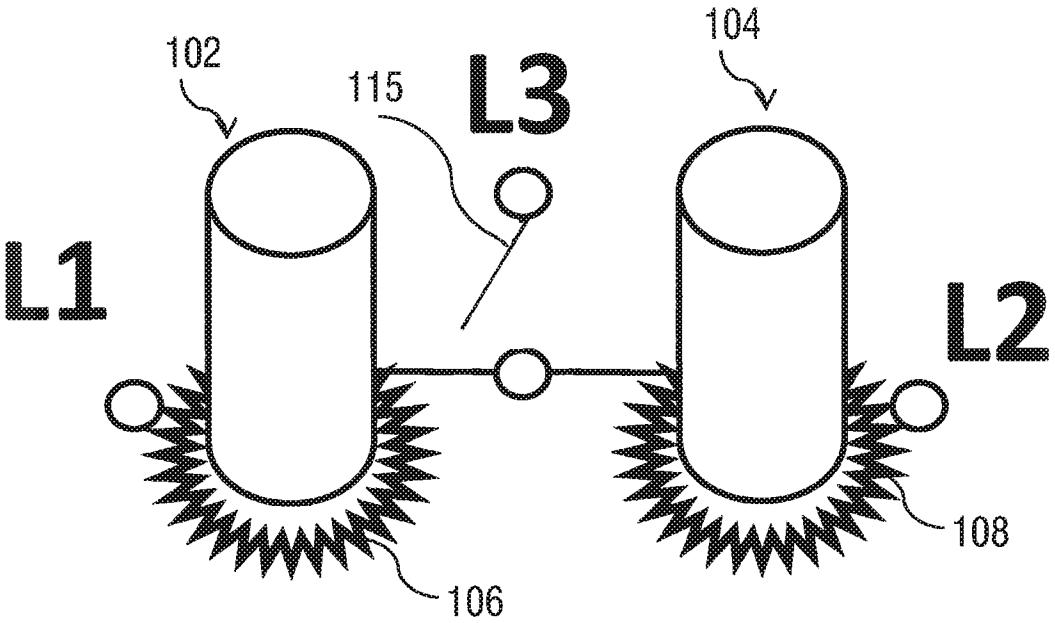
FIG. 4B is an electrical diagram of heaters of a compressor assembly operating in a second mode.

Referring to FIGS. 4A and 4B, the first heater 106 and the second heater 108 may be configured to operate in one or more modes. Referring to FIG. 4A, in a first mode, the first heater 106 and the second heater 108 may operate in parallel. Parallel operation in the first mode increases power output of each heater 106, 108 and is referred to as a "boost setting." In some embodiments, the boost setting delivers 200 W of heating power through the first heater 106 and the second heater 108. This example of the wattage of the boost setting is based on the properties of the compressor units 102, 104, including the compressor capacity, the frame of crankcases 111, 113, and amount of oil in the HVAC system 1000, among other known factors. It will be understood by persons of ordinary skill in the art that the wattage delivered in the boost setting is compressor specific, and may be varied to accommodate relevant properties of the compressor units 102, 104 and also vary the time that the compressor assembly 100 is operated in the first mode of operation at the boost setting.

Referring to FIG. 4B, in a second mode of operation, the first heater 106 and the second heater 108 may operate in series. Series operation in the second mode reduces power delivered to the heaters 106, 108 compared to parallel operation by increasing total resistance and reducing the total wattage of the circuit. For example, the first heater 106 and the second heater 108 on each crankcase 111 and 113, respectively, operate in parallel at a rate of thermal transfer of 200 W per heater for a supply voltage of 460V. When the crankcase heaters 106, 108 are re-configured in series, the voltage across each heater drops to one-half, e.g. 230V, and the wattage of each heater drops to one-fourth, e.g. 25 W.

Referring to FIG. 2, the controller 110 may be configured to vary the rate of transfer of thermal energy transferred between at least two substantially non-zero levels. In the embodiment shown in FIGS. 4A and 4B, first line L1, second line L2, and third line L3 may be configured to deliver power to the first heater 106 and the second heater 108. In the first mode shown in FIG. 4A, the controller 110 may configure a first relay 115, a second relay 117, and a third relay 119 to operate the heaters 106, 108 in parallel. In the second mode shown in FIG. 4B, the controller 110 may configure the first relay 115 to operate the heaters 106, 108 in series.

In some embodiments, the controller 110 may regulate voltage to each of the first heater 106 and the second heater 108 for operation in at least the second mode and first mode. The first mode and the second mode may comprise a substantially non-zero value of total voltage delivered between the first heater 106 and the second heater 108.

Daily Start-Up

Referring to FIGS. 5A-E, and 6, the compressor assembly 100 may be utilized to perform one or more methods for maintaining a temperature profile within an enclosed space, such as in a home or business. In a first method 200 shown in FIG. 6, the compressor assembly 100 may maintain the compressor units 102, 104 in a substantially ready-for-operation configuration. The ready-for-operation configuration may include substantially maintaining refrigerant outside the compressor sump. In some embodiments, the ready for operation state is achieved when the compressor sump temperature exceeds the saturated suction temperature by 10.degree. C.

In a first step 202, the controller 110 may initiate the first mode of operation of the HVAC system 1000 based on a first operating condition. In some embodiments, the first operating condition is a pre-programmed time of day.

Figure 5A:
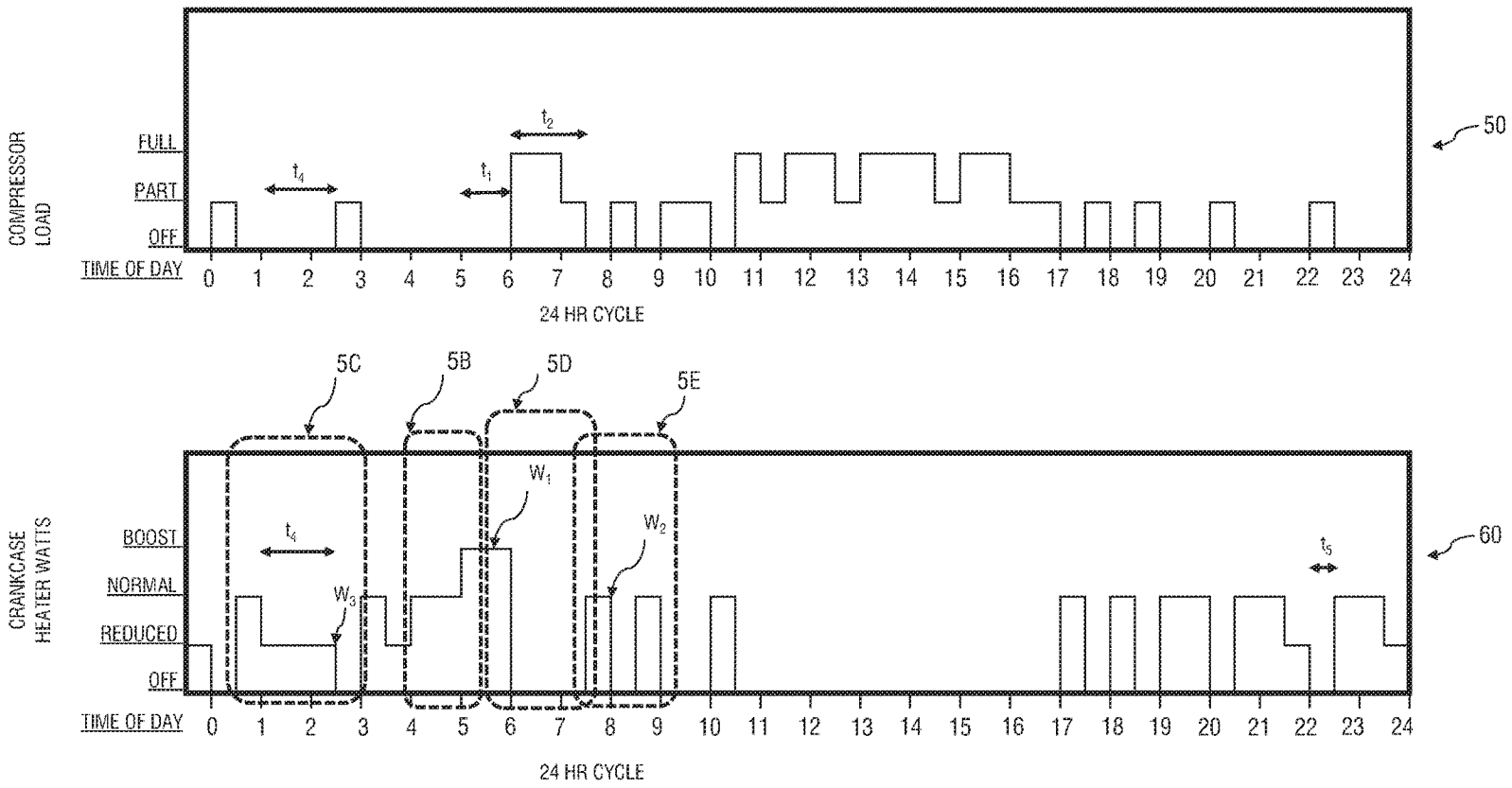
FIGS. 5A-5E illustrate a wattage one-day cycle for the operation of the HVAC system 1000.
Figure 5B:
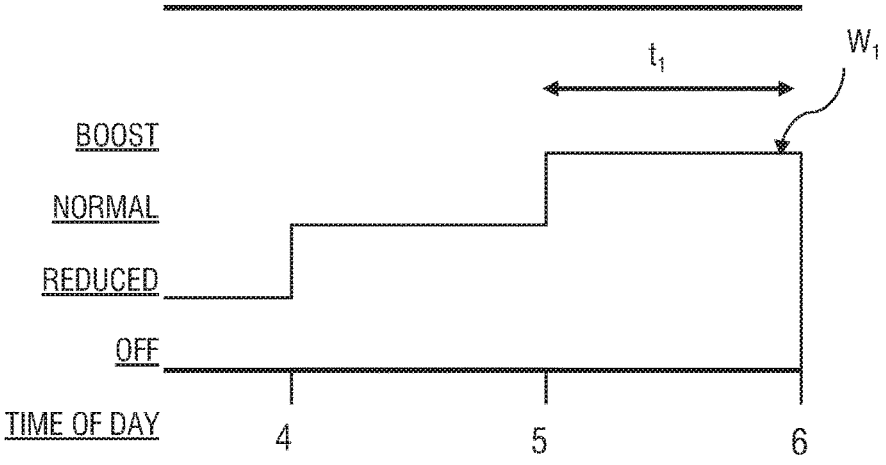

The controller 110 may be configured with timing and clock functions to provide time of day information to allow the controller 110 to operate the first heater 106 and the second heater 108. The pre-programmed time may be chosen to precede the anticipated first start of the day of the compressor assembly 100. For example, as shown in FIGS. 5A and 5B, the controller 110 may operate the first heater 106 and the second heater 108 in parallel at the boost setting having a boost wattage $W_1$ (as shown in wattage profile 60) of FIG. 5A at 5:00 a.m., which is a time when the day may be expected to be normally its coolest. The first mode of operation prepares the compressor assembly 100 for normal daily operation by placing the compressor assembly 100 in the ready-for-operation configuration.

In other embodiments, the first operating condition may be a manual command from a user. For example, a user may manually initiate the first step 202 through a control panel (not shown) operationally connected to controller 110. In other embodiments, the start-up condition may be an automatic command based on a pre-selected event or environmental condition. For example, the controller 110 may initiate the first step 202 when the outside temperature reaches a pre-determined level for the first time in a season. Other useful operating conditions may initiate the first step 202, including but not limited to as a reset of the HVAC system 1000 and as part of a diagnostic test.

In a second step 204, the controller 110 may deliver the boost wattage $W_1$ (i.e. the boost setting) for a period $t_1$ of time. For example, the time period $t_1$ may comprise a one hour period from 5:00 a.m. to 6:00 a.m. The period $t_1$ of time may terminate based on a termination condition. The termination condition may comprise a pre-determined amount of time calculated to place the compressor units 102, 104 in the ready-for-operation configuration. Alternatively, the period $t_1$ may be set to end when the compressors 102, 104 are first started under a substantially loaded condition.

Operating the first heater 106 and the second heater 108 in the first mode raises the output wattage delivered to the compressor units 102, 104 to the boost wattage $W_1$, which may comprise about 100 W per heater, i.e. the boost setting, as shown in FIGS. 5A and 5B. This condition raises the compressor sump temperature moving refrigerant out of the compressor sump.

Figure 6:
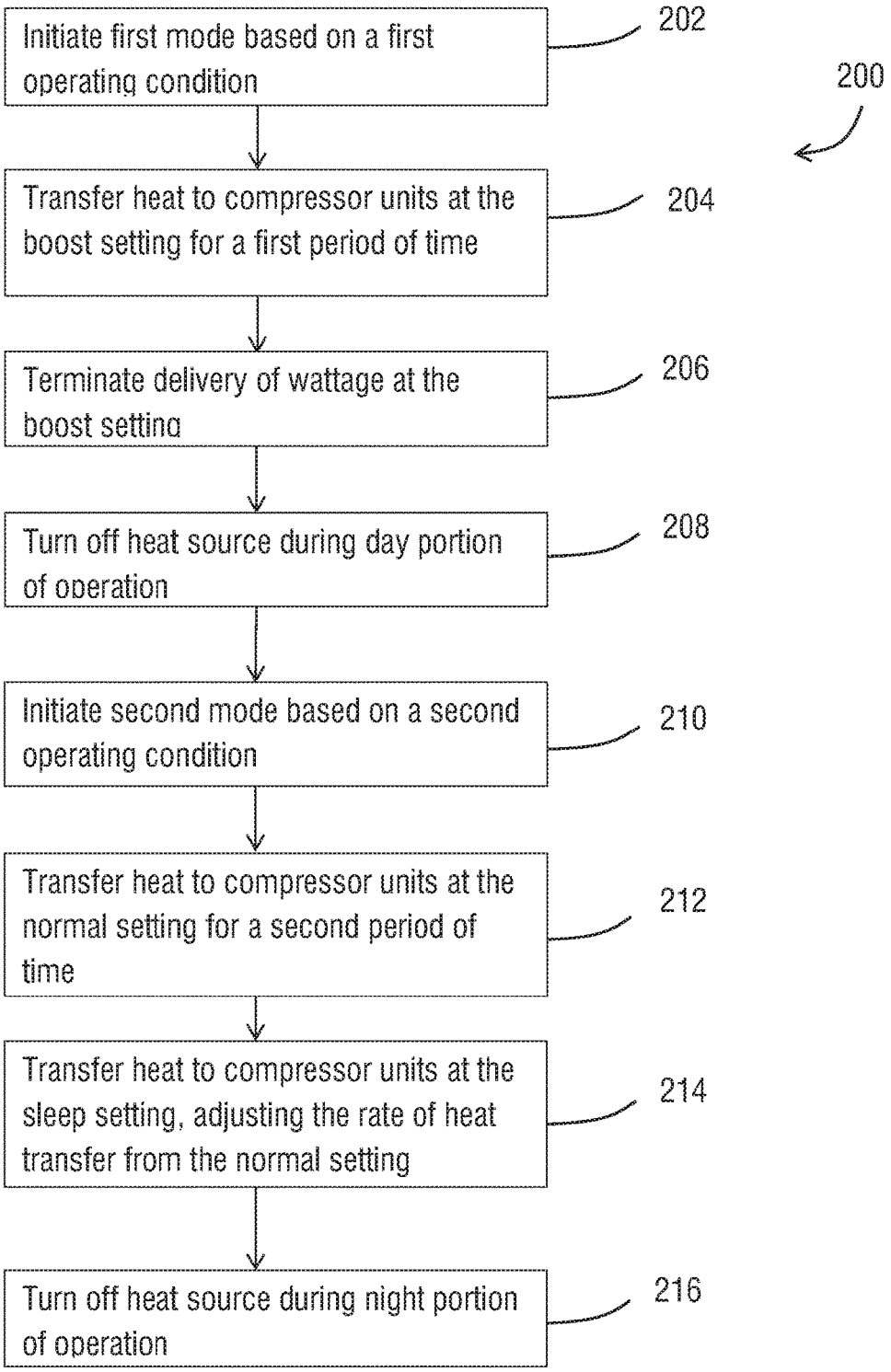
FIG. 6 shows steps in a method for maintaining a temperature profile within an enclosed space, such as a home or business.

In a third step 206, as shown in FIG. 6, the controller 110 may terminate the first mode of operation, i.e. at the end of period $t_1$ or in response to another automatic command or a manual command. In a fourth step 208, the controller 110 may turn off the first heater 106 and the second heater 108 for a compressor operating time period $t_2$. The compressor operating period $t_2$ may occur one or more times during a day portion of the cycle, as the compressor units 102, 104 cycle on and off to maintain the desired environment in the enclosed space.

Figure 5C:
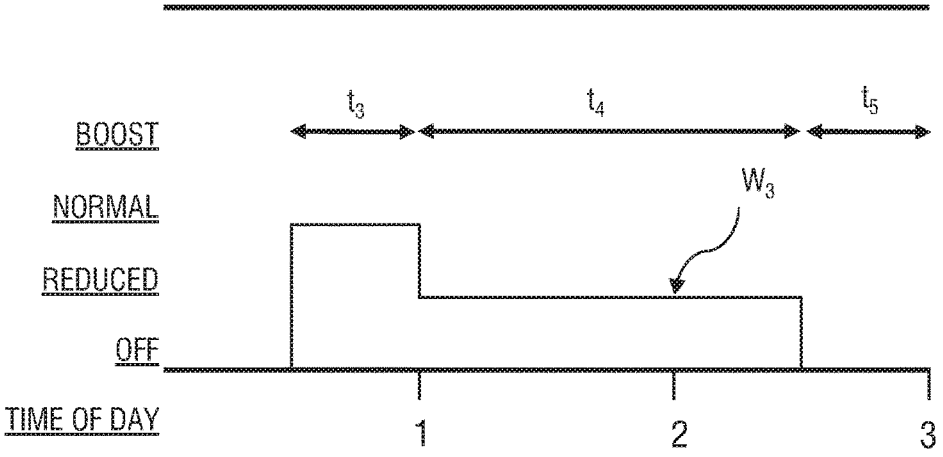
Figure 5D:
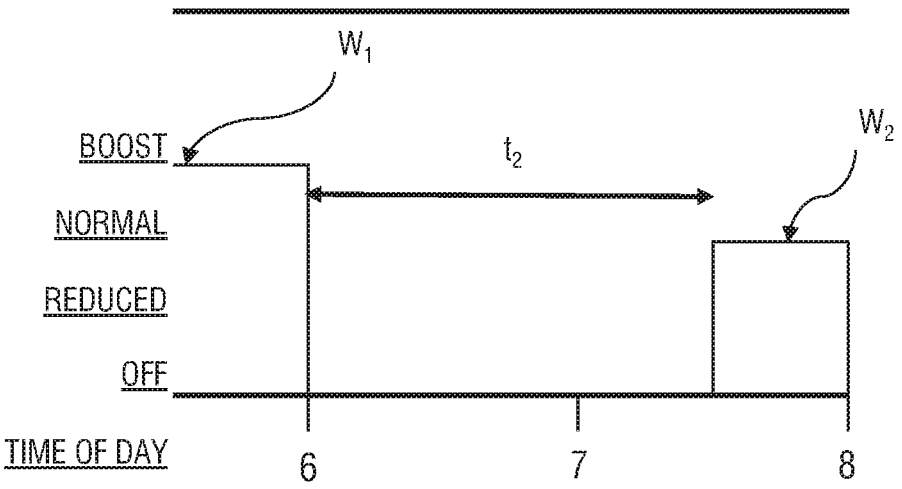
Figure 5E:
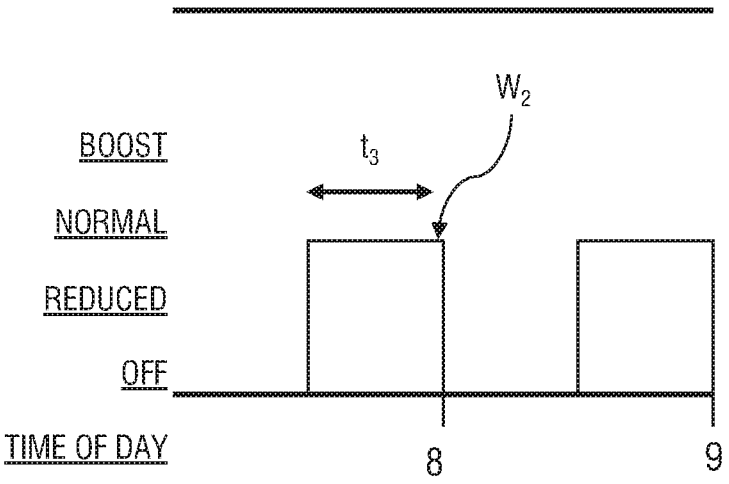

During the compressor operating time period $t_2$, the compressor units 102, 104 may turn on under a full or partial load, as shown in load profile 50 of FIG. 5A. The heaters 106, 108 may remain off during this time period. For example, as shown in FIGS. 5A and 5D, first heater 106 and the second heater 108 may turn off during a one and a half hour time period $t_2$ between 6:00 a.m. and 7:30 a.m. The time of day 6:00 a.m. may correspond to a time when a homeowner or facility manager would like a heating or cooling cycle to begin to prepare the enclosed space for occupancy.

In other embodiments, the heaters 106, 108 may operate under a reduced setting during operating period $t_2$. The reduced setting may comprise a wattage less than the normal setting to address environmental outside conditions, such as outside temperature.

In a fifth step 210, the controller 110 may initiate the second mode of operation of HVAC system 1000, based on a second operating condition. For example, after the compressor units 102, 104 are off and are no longer loaded, the controller 110 may configure the heaters to operate at the normal setting.

The second operating condition triggering the second mode of operation may be a combination of factors based on time of day, environmental conditions, and the state of the compressor units 102, 104. For example, the normal operating condition may comprise a time during the day and when the compressor units 102, 104 are off (e.g. during operating time period $t_2$). The outside temperature may also factor into whether to trigger the second mode of operation.

In a sixth step 212, the controller 110 may deliver the wattage $W_2$, i.e. the normal setting, for a period $t_3$ of time. For example, in FIGS. 5A and 5E, period $t_3$ may comprise the time between 7:30 a.m. and 8:00 a.m. when the compressor units 102, 104 are off. The period $t_3$ may terminate based on a termination condition. The termination condition for period $t_3$ may occur when the compressors 102, 104 come under a partial or full load. The heaters 106, 108 may be operated at the normal wattage setting $W_2$ to maintain the compressors in the ready-to-operate configuration. In other embodiments, period $t_3$ of time may be a pre-determined amount of time. For example, $t_3$ may extend all day and through the on-off cycles of the compressor units 102, 104. Period $t_3$ of time may terminate at the end of the day when there is no longer a use for a climate-controlled space, based on a work day, a sunset time, or other pre-determined time or condition.

In a seventh step 214, the controller 110 may adjust the wattage delivered by the compressor heaters 106, 108 operating in the second mode, i.e. with the first heater 106 and the second heater 108 operating in series. In some embodiments, as shown in FIG. 5C, the controller 110 operating in the second mode may be configured to lower the wattage delivered at the normal setting to the reduced setting, i.e. a sleep setting. The wattage $W_3$ delivered in the sleep setting may be about 25% of that delivered in the normal setting. The wattage of the reduced setting may be configured to provide an energy savings compared to turning off the compressor heaters or to operating the compressor heaters at the normal setting.

The reduced setting may be useful when it is expected or conditions arise indicating that the compressor units 102, 104 will not be operated for an extended period $t_4$ of time. For example, as shown in FIGS. 5A and 5C, when it is expected that the compressors units 102, 104 may not be operated under a full load for a few hours, the controller 110 may initiate the heaters 106, 108 to operate at the reduced setting during one or more interval period, e.g. the period $t_3$ of time from 1:00 a.m. to 2:30 a.m. Operating conditions that may trigger the reduced setting may comprise the outside ambient temperature reaching a threshold value, for example a relatively low temperature that may tend to cause refrigerant migration into the compressor sump 107, 109. Also, the reduced setting may initiate at a pre-selected time, such as a time prior to initiation of the boost setting as part of a morning start-up of the HVAC system 1000.

In an eighth step 216, the heaters 106,108 may be turned off during a night portion of operation of the HVAC system 1000. As shown in FIGS. 5A and 5C, one or more off periods $t_5$ of time may exist during the night when the first heater 106 and second heater 108 are both off with no power delivered to the either. For example, when the compressor units 102, 104 are operating at night under a partial load, there may be no substantial need for heating of the compressor units 102, 104.

It may be beneficial to turn off the heaters or to lower the wattage delivered to the compressor units 102, 104 by the heaters 106, 108 to save on energy costs. As shown in FIG. 5C during the night-time when compressor units 102, 104 may be expected to remain off or operate under only a partial load, the controller 110 may initiate intervals of operation at the normal setting (period $t_3$), at the reduced setting (period $t_4$), or off periods (period $t_5$). Operating the heaters 106, 108 in the second mode, in the normal setting or the reduced setting, prior to operation of the heaters 106, 108 in the first mode at the boost setting may also reduce the time needed, period $t_1$, to place the compressor assembly 100 in the ready-to-operate configuration.

In other embodiments, the heaters 106, 108 may operate in the second mode (corresponding to the time period $t_2$) throughout the remainder of the daily cycle to span the entire time that the first heater 106 and the second heater 108 are not operating in the first mode, including during nighttime periods of the daily cycle. The length and configuration of the time periods $t_1$, $t_2$, $t_3$, $t_4$, and $t_5$, may be determined and adjusted based on power consumption, desired comfort of occupants, and other factors that are readily apparent to persons of ordinary skill in the art. It will be understood by persons of ordinary skill in the art that the steps of methods 200 and 300 may be practiced in the order shown in FIGS. 6 and 8, or the steps may be practiced in alternative orders or in different combinations depending on the desired operating conditions of the HVAC system 1000 and air conditioning requirements.

Initial Start-Up

Figure 7:
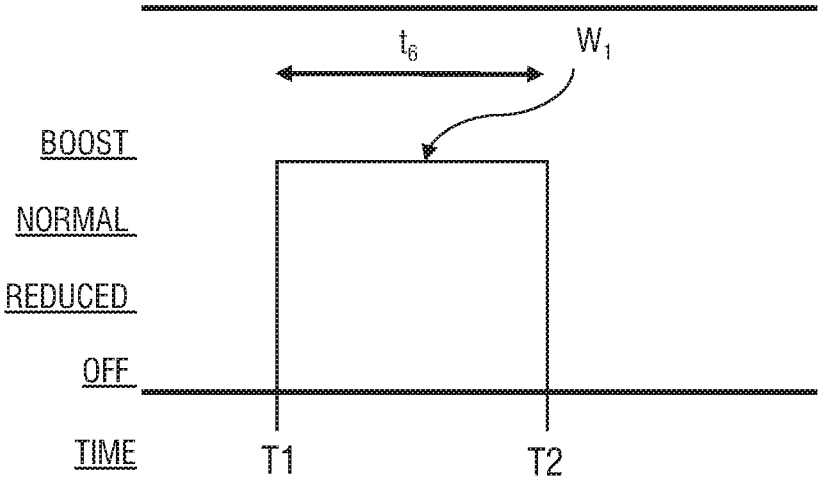
FIG. 7 illustrates a wattage timeline for preparing an HVAC system for normal operation at an initial start-up.
Figure 8:
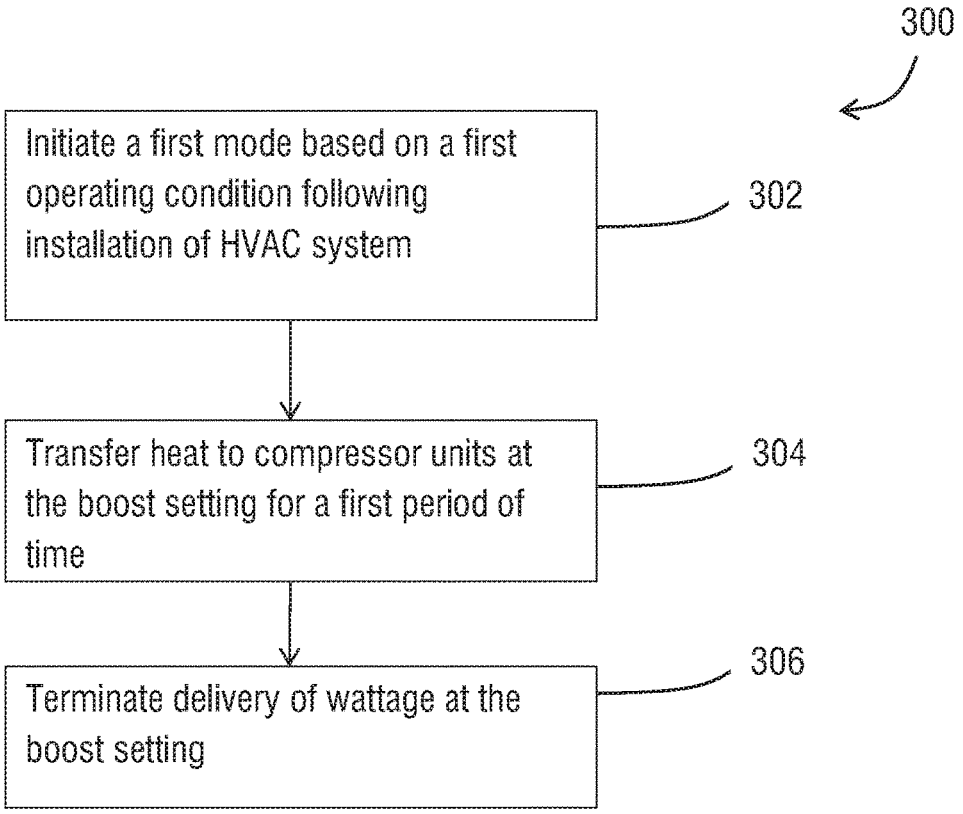
FIG. 8 shows steps in a method for preparing an HVAC system for normal operation at an initial start-up.

In a second method 300, as shown in FIGS. 7 and 8, the compressor assembly 100 may prepare the compressor units 102, 104 for normal operation for the first time following installation of the HVAC system 1000 at an installation site, such as a home or business. For example, the compressor assembly 100 may place the compressor units 102, 104 in a substantially ready-for-operation configuration.

In a first step 302, the controller 110 may initiate the first mode of operation of the HVAC system 1000 based on an initial start-up operating condition. In some embodiments, the initial start-up condition is a pre-programmed indication stored in the memory of the controller 110 that the HVAC system has not been started. The indication to start-up the HVAC system in the first mode of operation may be set as a factory setting and may be prompted by connecting the HVAC system to a power source. In other embodiments, the initial start-up condition may be a reset of the programming of the controller 110, either following an automatic reset or a manual reset, for example a reset following servicing or repair of the HVAC system 1000. In other embodiments, the party installing the HVAC system 1000 may manually select the time for performing the first step 302, according to conditions of use of the HVAC system 1000. For example, the installing party may delay start-up until other HVAC systems are installed at the installation site.

In a second step 304, the controller 110 may deliver at time $T_1$ a pre-determined start-up wattage $W_1$ for a period $t_6$ of time until time $T_2$. Period $t_6$ may be a pre-determined amount of time or may be set to end when the compressors 102, 104 is first started. Period $t_6$ may be calculated based on the properties of the HVAC system 1000, e.g. the time needed to place the compressors 102, 104 in the ready-for-operation configurations.

Operating the first heater 106 and the second heater 108 in the first mode may raise the output wattage delivered to the compressor to about 200 W per heater, i.e. the boost setting as shown in FIG. 7. Before the initial start-up, oil and refrigerant may have migrated and settled in the compressor sump. This condition may raise the compressor sump pressure moving refrigerant out of the compressor and also increases the amount of refrigerant in the condenser to place the compressor units in the ready-for-operation configuration.

In a third step 306, the controller 110 may terminate delivery of wattage at the boost setting. The controller 110 may be operated from that point forward according to the first method 200, described above. For example, the heaters 102, 104 may transition to operation in the second mode at a normal or reduced setting, as shown in FIG. 5A.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. A system for heating a compressor assembly of a heating, ventilation, and air conditioning (HVAC) system, the system comprising:

a heat source comprising a first heater and a second heater, wherein the heat source is configured to transfer thermal energy to first and second compressor units of the compressor assembly;

a controller operationally connected to the heat source, wherein the controller is configured to vary the thermal energy transferred to the first and second compressor units between at least three substantially non-zero rates of transfer of thermal energy in at least a first mode of operation and a second mode of operation of the HVAC system;

wherein the first mode of operation comprises transferring heat, by the first heater and the second heater, to the first and second compressor units at a first setting, wherein the first setting comprises a non-zero first rate of transfer of thermal energy;

wherein the second mode of operation comprises transferring heat, by the first heater and the second heater, to the first and second compressor units at a second setting, wherein the second setting comprises a non-zero second rate of transfer of thermal energy;

wherein the controller is configured to:

set a rate of transfer of thermal energy by the first heater and second heater to a third setting, wherein the third setting comprises a non-zero third rate of transfer of thermal energy that is less than the non-zero second rate of transfer of thermal energy; and operate the first heater and the second heater at the non-zero third rate of transfer of thermal energy, when the HVAC system is in the second mode of operation.

2. The system of claim 1, wherein the first heater is mounted to a first crankcase of the first compressor unit and the second heater is mounted to a second crankcase of the second compressor unit, and wherein the first heater and the second heater are mounted to transfer heat to a first compressor sump of the first compressor unit and a second compressor sump of the second compressor unit, respectively, for placing the first compressor unit and the second compressor unit in a ready-to-operate configuration.

3. The system of claim 1, wherein the controller is further configured to initiate the second mode of operation to transfer heat at the non-zero third rate of transfer of thermal energy, based on a third operating condition.

4. The system of claim 1, wherein, in the first mode of operation, the controller is configured to increase power output of the first and second heaters by operating the first and second heaters in parallel.

5. The system of claim 1, wherein, in the second mode of operation, the controller is configured to decrease power output of the first and second heaters by operating the first and second heaters in series.

6. The system of claim 1, wherein the non-zero second rate of transfer of thermal energy is less than the non-zero first rate of transfer of thermal energy.

7. The system of claim 1, wherein the first heater and the second heater each comprise a resistance-element-type heater.

8. The system of claim 3, wherein the third operating condition comprises an outside temperature reaching a threshold value.

9. The system of claim 1, wherein:

the controller comprises a time function; and a first operating condition for initiating the first mode of operation comprises a time of day.

10. The system of claim 1, wherein a second operating condition comprises at least one of the first compressor unit and the second compressor unit operating under a loaded condition.

11. A compressor assembly configured to operate in a heating, ventilation, and air conditioning (HVAC) system, the compressor assembly comprising:

a first compressor unit;

a second compressor unit, wherein the first and second compressor units are operationally connected to the HVAC system;

a first heat source comprising a first heater for transferring thermal energy to the first compressor unit;

a second heat source comprising a second heater for transferring thermal energy to the second compressor unit;

a controller operationally connected to the first heat source and the second heat source;

wherein the controller is configured to vary the thermal energy transferred to the first and second compressor units between at least three substantially non-zero amounts of thermal energy in at least a first mode of operation and a second mode of operation of the HVAC system;

wherein the first mode of operation comprises transferring heat, by the first heater and the second heater, to the first and second compressor units at a first setting, wherein the first setting comprises a non-zero first rate of transfer of thermal energy;

wherein the second mode of operation comprises transferring heat, by the first heater and the second heater, to the first and second compressor units at a second setting, wherein the second setting comprises a non-zero second rate of transfer of thermal energy;

wherein the controller is configured to:

set a rate of transfer of thermal energy by the first heater and second heater to a third setting, wherein the third setting comprises a non-zero third rate of transfer that is less than the non-zero second rate of transfer of thermal energy; and operate the first heater and the second heater at the non-zero third rate of transfer, when the HVAC system is in the second mode of operation.

12. The compressor assembly of claim 11, wherein the controller is further configured to initiate the second mode of operation to transfer heat at the non-zero third rate of transfer, based on a third operating condition.

13. The compressor assembly of claim 11, wherein:

the first heater is mounted to a first crankcase of the first heater and the second heater is mounted to a second crankcase of the second heater, and wherein the first heater and the second heater are mounted to transfer heat to a first compressor sump of the first heater and a second compressor sump of the second heater, respectively, for placing the first compressor unit and the second compressor unit in a ready-to-operate configuration.

14. The compressor assembly of claim 11, wherein, in the first mode of operation, the controller is configured to increase power output of the first and second heaters by operating the first and second heaters in parallel.

15. The compressor assembly of claim 11, wherein, in the second mode of operation, the controller is configured to decrease power output of the first and second heaters by operating the first and second heaters in series.

16. The compressor assembly of claim 11, wherein the non-zero second rate of transfer of thermal energy is less than the non-zero first rate of transfer of thermal energy.

17. The compressor assembly of claim 11, wherein the first heater and the second heater each comprise a resistance-element-type heater.

18. The compressor assembly of claim 12, wherein the third operating condition comprises an outside temperature reaching a threshold value.

19. The compressor assembly of claim 11, wherein:

the controller comprises a time function; and a first operating condition for initiating the first mode of operation comprises a time of day.

20. The compressor assembly of claim 11, wherein a second operating condition comprises at least one of the first compressor unit and the second compressor unit operating under a loaded condition.

* * * * *